US007913470B2

(12) United States Patent
Siodla et al.

(10) Patent No.: US 7,913,470 B2
(45) Date of Patent: Mar. 29, 2011

(54) INSULATING STRIP FOR SUPPORTING A COMPOSITE STRUCTURE

(75) Inventors: Thorsten Siodla, Baunatal (DE); Erwin Brunnhofer, Fuldabrueck (DE)

(73) Assignee: Technoform Caprano und Brunnhofer GmbH & Co. KG, Fuldabrück (DE)

( * ) Notice: Subject to any disclaimer, the term of this patent is extended or adjusted under 35 U.S.C. 154(b) by 51 days.

(21) Appl. No.: 12/061,142

(22) Filed: Apr. 2, 2008

(65) Prior Publication Data

US 2008/0256893 A1 Oct. 23, 2008

(30) Foreign Application Priority Data

Apr. 2, 2007 (DE) ..... 20 2007 004 935 U
Jun. 28, 2007 (DE) ..... 20 2007 009 106 U
Nov. 27, 2007 (DE) ..... 20 2007 016 649 U

(51) Int. Cl.
*E04B 1/342* (2006.01)

(52) U.S. Cl. ..... 52/586.2; 52/426; 52/717.02; 52/698; 52/836; 403/331; 403/364

(58) Field of Classification Search ..... 52/404.1, 52/405.4, 406.2, 404.4, 222, 717.02, 656.6, 52/844, 590.1, 590.2, 586.1, 586.2, 564, 52/568, 426, 698, 836; 49/DIG. 1; 403/329, 403/331, 364
See application file for complete search history.

(56) References Cited

U.S. PATENT DOCUMENTS 2,660,275 A * 11/1953 Beck ..... 52/204.597
3,729,045 A * 4/1973 MacDonald ..... 160/371
3,861,085 A 1/1975 Jacob
3,878,660 A 4/1975 Jacob
4,057,945 A * 11/1977 Kessler ..... 52/204.593
4,067,163 A 1/1978 Hetman
4,115,972 A 9/1978 Varlonga
4,128,934 A 12/1978 Doring
4,158,512 A * 6/1979 Hasselbacher ..... 403/294
4,184,297 A * 1/1980 Casamayor ..... 52/202
4,189,880 A * 2/1980 Ballin ..... 52/202

(Continued)

FOREIGN PATENT DOCUMENTS

AT 379207 12/1985

(Continued)

OTHER PUBLICATIONS

International Search Report for PCT/EP2008/002543.

(Continued)

*Primary Examiner* — Robert J Canfield
*Assistant Examiner* — Matthew J Gitlin
(74) *Attorney, Agent, or Firm* — J-Tek Law PLLC; Jeffrey D. Tekanic

(57) ABSTRACT

An insulating strip is configured to support two profiles or frames in a spaced relationship. The insulating strip includes a body extending in a longitudinal direction and has at least first and second longitudinal edges. The longitudinal edges are configured to be connected with the respective frames or profiles in a shear-resistant manner. Openings penetrate through one or more walls of the body and one or more struts separate the openings from each other in the longitudinal direction of the body. The body further comprises at least one attachment structure configured to retain a covering profile configured to cover the openings. The covering profile may be integral with the insulating strip body or may be a separate part. A composite structural unit comprises two frames supported in a spaced relationship by such an insulating strip.

20 Claims, 14 Drawing Sheets

U.S. PATENT DOCUMENTS

| | | | | |
|---|---|---|---|---|
| 4,219,983 | A * | 9/1980 | Kern et al. | 52/204.599 |
| 4,272,941 | A | 6/1981 | Hasselbacher et al. | |
| 4,524,112 | A * | 6/1985 | Willert | 428/595 |
| 4,548,015 | A * | 10/1985 | Switzgable | 52/586.2 |
| 4,617,772 | A * | 10/1986 | Hassell | 52/461 |
| 4,777,777 | A * | 10/1988 | Massimo | 52/586.2 |
| 4,788,806 | A * | 12/1988 | Sease | 52/222 |
| 4,850,175 | A * | 7/1989 | Berdan | 52/786.13 |
| 4,866,895 | A * | 9/1989 | Hlavaty | 52/208 |
| 5,117,601 | A | 6/1992 | Habicht | |
| 5,313,761 | A | 5/1994 | Leopold | |
| 5,641,239 | A * | 6/1997 | Michalek | 403/397 |
| 5,675,944 | A | 10/1997 | Kerr et al. | |
| 5,694,731 | A | 12/1997 | Tonsmann et al. | |
| 5,727,356 | A * | 3/1998 | Ensinger et al. | 52/717.02 |
| 6,035,596 | A * | 3/2000 | Brunnhofer | 52/404.1 |
| 6,035,600 | A | 3/2000 | Habicht et al. | |
| 6,038,825 | A | 3/2000 | Shah et al. | |
| 6,068,720 | A | 5/2000 | McHugh | |
| 6,339,909 | B1 | 1/2002 | Brunnhofer et al. | |
| 2002/0134041 | A1* | 9/2002 | Lofstrom | 52/590.1 |
| 2004/0177579 | A1* | 9/2004 | Tremelling | 52/426 |
| 2005/0100691 | A1 | 5/2005 | Bunnhofer et al. | |
| 2005/0183351 | A1 | 8/2005 | Brunnhofer | |
| 2006/0117693 | A1* | 6/2006 | Garrett | 52/426 |
| 2006/0277859 | A1* | 12/2006 | Egli et al. | 52/730.4 |
| 2008/0022619 | A1* | 1/2008 | Scherrer | 52/407.5 |
| 2010/0115850 | A1 | 5/2010 | Siodla et al. | |

FOREIGN PATENT DOCUMENTS

| | | | |
|---|---|---|---|
| DE | 1245568 | | 5/1962 |
| DE | 1174483 | | 7/1964 |
| DE | 1214375 | | 4/1966 |
| DE | 1659428 | | 8/1967 |
| DE | 1943594 | | 3/1970 |
| DE | 1940791 | | 2/1971 |
| DE | 1951517 | | 4/1971 |
| DE | 7128512 | | 10/1971 |
| DE | 2033442 | | 1/1972 |
| DE | 2100620 | | 7/1972 |
| DE | 2103904 | | 8/1972 |
| DE | 2122016 | | 11/1972 |
| DE | 2137145 | | 2/1973 |
| DE | 7243199 | | 3/1973 |
| DE | 7305385 | | 6/1973 |
| DE | 2217877 | | 10/1973 |
| DE | 2300532 | | 4/1974 |
| DE | 2257670 | | 5/1974 |
| DE | 2412317 | | 9/1974 |
| DE | 2333420 | | 1/1975 |
| DE | 2265017 | | 3/1976 |
| DE | 2522212 | | 12/1976 |
| DE | 2536666 | | 2/1977 |
| DE | 2608299 | | 9/1977 |
| DE | 2660436 | | 9/1977 |
| DE | 2701942 | | 7/1978 |
| DE | 2715007 | | 10/1978 |
| DE | 2715010 | | 10/1978 |
| DE | 2729882 | | 1/1979 |
| DE | 2729909 | | 1/1979 |
| DE | 2746434 | | 4/1979 |
| DE | 7903259 | | 6/1979 |
| DE | 2908950 | | 9/1980 |
| DE | 8220695 | | 2/1983 |
| DE | 3334332 | | 4/1985 |
| DE | 3418470 | | 11/1985 |
| DE | 3425135 | | 1/1986 |
| DE | 3939968 | | 6/1991 |
| DE | 19532125 | | 1/1997 |
| DE | 19735702 | A1 | 2/1999 |
| DE | 19818769 | A1 | 11/1999 |
| DE | 29821183 | U1 | 3/2000 |
| DE | 19853235 | A1 | 5/2000 |
| DE | 19956415 | C1 | 3/2001 |
| EP | 0166021 | | 1/1986 |
| EP | 0657612 | | 6/1995 |
| EP | 0829609 | | 3/1998 |
| EP | 1004739 | A2 * | 5/2000 |
| EP | 0978619 | B1 | 6/2003 |
| EP | 1004739 | B1 | 2/2004 |
| FR | 2055372 | | 5/1971 |
| FR | 2123311 | | 9/1972 |
| FR | 2123471 | | 9/1972 |
| FR | 2396198 | | 1/1979 |
| FR | 2454744 | | 11/1980 |
| GB | 1271949 | | 4/1972 |
| GB | 1331390 | | 9/1973 |
| GB | 2049775 | | 12/1980 |
| WO | 2008119535 | A1 | 10/2008 |

OTHER PUBLICATIONS

International Preliminary Report on Patentability for PCT/EP2008/002543.

Siodla, Thorsten et al., "Composite Profile and Insulating Strip Therefor," Unpublished U.S. Appl. No. 12/594,337, filed Oct. 1, 2009, claiming priority to International Patent Application Serial No. PCT/EP2008/002543, published as WO2008/119535A1 on Oct. 9, 2008.

International Preliminary Report on Patentability for related PCT Application No. PCT/EP2008/002543 directed to original claims 1-6 of US 2010/0115850.

Office Action from EPO dated Apr. 15, 2010 concerning related European patent application No. 08 734 902.3, which Office action is directed to claims substantially corresponding to original claims 1-6 of US 2010-0115850, including partial translation of the Office Action with respect to the portion discussing novelty.

English translation of EP 1 004 739 A2 (with amendments made by Applicant thereof during examination before the EPO).

Second Preliminary Amendment filed U.S. Appl. No. 12/594,337 (US 2010/0115850) on Sep. 3, 2010.

* cited by examiner a)

b)

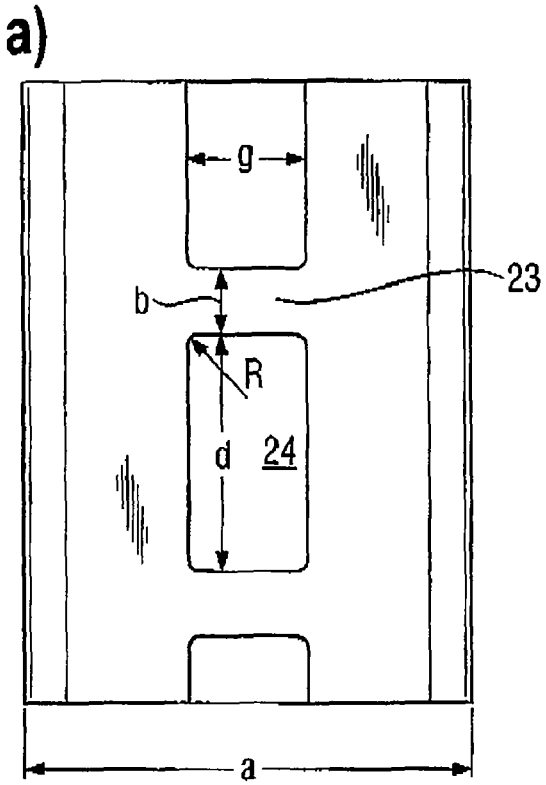
Fig. 10
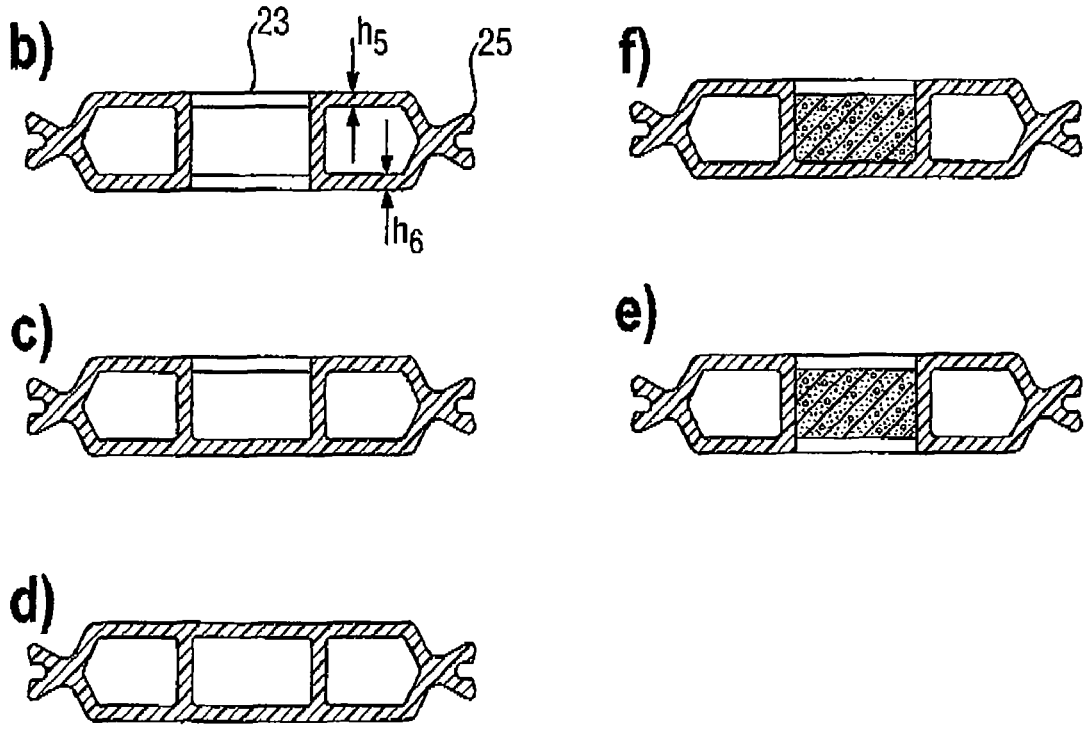

a)

d)

b)

c)

INSULATING STRIP FOR SUPPORTING A COMPOSITE STRUCTURE

CROSS-REFERENCE

The present application claims priority to German utility model application number 20 2007 004 935.8 filed Apr. 2, 2007, German utility model application number 20 2007 009 106.0 filed Jun. 28, 2007 and German utility model application number 20 2007 016 649.4 filed Nov. 27, 2007, all of which are incorporated herein by reference as if fully set forth herein.

TECHNICAL FIELD

The present invention relates to insulating or separating strips that may be utilized, e.g., to separate and position two profiles or frames of, e.g., a window, a door or a façade. In a preferred embodiment, the insulating or separating strip may provide a shear-resistant connection of the two profiles or frames, even when the respective profiles or frames are subjected to different temperature environments.

BACKGROUND

In recent years, the use of double pane or double profile structures has become more common in order to substantially reduce heat transfer through, e.g., window, doors, façades and other building structures. Typically, such structures include an outer metal profile or frame, an inner metal profile or frame and one or more insulating strips or struts for maintaining the inner and outer profiles or frames in a spaced relationship. In addition, such insulating strips or struts are often made of a material exhibiting low conductivity in order to substantially minimize heat transfer from a warm side to a cold side of the composite structure.

However, as discussed in U.S. Pat. No. 6,035,600, in the event that one of the metal frames is subjected to a significantly different temperature environment than the other, thermal expansion of the warmer frame results in a displacement force between the respective frames of the composite section. As a result, the composite structure may bend or flex due to relative longitudinal displacement of the respective frames. This is known in the art as a "bimetal effect", although it is not necessary for the frames to be comprised of different metals. Rather, it only refers to the different thermal expansions of the metal frames caused, e.g., by the metal frames being at different temperatures.

Heat sources causing a unilateral temperature rise include, e.g., temperature differences between a room interior and the outside air (e.g., in winter) or incident solar radiation upon the outer frame (e.g., in summer) that causes the temperature of the outer frame to rise due to absorption of solar energy. The resulting deformation of the composite structure causes an arching that may impair the function of the window, door or façade element. U.S. Pat. No. 6,035,600 proposes an insulating rod for connecting frames that is purported to provide a slight resistance to such relative longitudinal displacement.

German Patent No. 199 56 415 C1 discloses another solution to this longitudinal displacement problem. Two longitudinal edges of an insulating profile are connected by a substantially U-shaped outer bridge. The two longitudinal edges are respectively fitted to the outer and inner metal frames of a window, door or façade element. The insulating profile is preferably made of a synthetic material, such as polyamide, polyester or polypropylene, and has a Young's modulus of greater than 2,000 N/mm$^2$. The U-shaped bridge imparts a sheer-resistant connection between the inner and outer frames and resists relative longitudinal displacement in the event that the inner and outer frame are subjected to different temperature environments.

German Patent Publication No. 198 53 235 A1 discloses an alternate solution to this problem. In certain embodiments thereof, the insulating strip has a ladder-like structure, wherein a plurality of rungs or bars extend between respective longitudinal edges adapted to be connected to respective inner and outer metal frames of a window, door or façade. The openings between the rungs may have a circular-shape, a rectangular-shape, an oval-shape or a slot-shape. The insulating profile may be co-extruded using two materials having different hardness, such that the inner rungs exhibit an increased elasticity as compared to the longitudinal edges. This design purports to minimize or prevent bending or deflection of the two sides of the composite profile due to temperature differences. In order to prevent the penetration of moisture and/or dust through the openings, this reference recommends covering the openings with a film, a sealing tape or a dipping varnish.

An insulating strip having a metal insert embedded in plastic is also known from DE 198 18 769. This insulating strip also has openings that impart a ladder-like structure to it. The openings may be square-shaped, rectangular-shaped or substantially triangular-shaped. The openings in the metal insert are intended to reduce thermal conduction and the metal insert serves to prevent a complete failure or collapse of the insulating strip in the event of a fire.

SUMMARY

However, there remains in the art a need to provide improved insulating strips or struts, which may be utilized, e.g., in composite structures, such as composite profiles or frames. In certain representative embodiments, such insulating strips or struts exhibit relatively high shear strength while still providing improved thermal isolation and reduced risk of contamination of the interior portion of the composite structure.

In one aspect of the present teachings, an insulating strip may be designed, e.g., for a window unit, a door unit, a façade unit and/or another type of architectural unit, or any other unit that is generally comprised of two frames or profiles supported in a spaced relationship relative to each other.

The insulating strip preferably has a body portion extending in a longitudinal direction (Z) and includes at least two longitudinal edges separated by a distance (a) in a transverse direction (X). The longitudinal edges are preferably configured or constructed for a shear-resistant connection with profiled or shaped components of the respective frames or profiles, such as the above-noted architectural units.

The insulating strip preferably has openings that penetrate through one or more walls of the body in a height-direction (Y) of the insulating strip. The openings are preferably separated from each other in the longitudinal direction (Z) by struts, bars, strips, supports, etc. These structures may, in certain embodiments, give the insulating strip an overall ladder-shaped appearance in plan view. However, in other embodiments, the openings in the insulating strip may be circular, oval, hexagonal, i.e. other than square or rectangular, without departing from the scope of the present teachings.

The insulating strip preferably includes a connecting element or structure configured to attach a covering element or profile thereto. Such a covering element may serve to cover the openings in the insulating strip, thereby preventing contamination from entering into the interior space defined between the two frames or profiles of the assembled composite structural unit.

In a further preferred embodiment, the covering element or profile is integrally formed with the insulating strip and includes a clip element configured to detachably connect with a terminal portion of the covering profile or element. Such covering profiles or covering sheets preferably cover the intervening spaces or openings between the rungs, struts.

The covering profiles or covering sheets can, for example, be clipped on, adhered to, extruded on, laminated to, etc., the insulating strip body. The covering profiles/sheets may be either integral with the insulating strip body or a separate piece.

Such covering profiles may, on the one hand, serve to prevent moisture from penetrating into a space or gap between the frames of the assembled composite structural unit. In addition or in the alternative, the covering profiles may also protect the inner core. The covering profiles or covering sheets can be attached to the frames before or after the assembly of the units. Decorative elements can also be attached thereto.

In a further aspect of the present teachings, one or more clip heads may project from at least one side of the insulating strip in the height-direction (Y). In addition or in the alternative, one or more clip retainers may also extend in the height-direction (Y), preferably from an opposite side of the insulating strip. The clip retainer(s) preferably define(s) a recess configured to receive and retain the clip head(s). These clip heads and clip retainers may preferably serve to clip-fit or snap-fit a covering element or profile onto the insulating strip, thereby securely covering the openings in the insulating strip.

In a further aspect of the present teachings, the covering profile may be in situ extruded together with the insulating strip body and may be configured to be bent over the insulating strip so as to cover one side of the openings. A portion of the covering profile is further preferably configured to be clipped or otherwise connected to the insulating strip body, thereby securing the covering profile in a position that covers the openings in the insulating profile.

In a further aspect of the present teachings, the covering profile may be separate from the insulating strip body and may optionally have a width in the transverse direction that is less than the width of the insulating strip body. In this case, the covering profile may include clip heads and/or clip retainers that is/are complementary to the clip heads and/or clip retainers defined on the insulating strip, as was indicated above. In addition or in the alternative, the covering profile may include abutment lips extending in the longitudinal direction (Z), which abutment lips are configured to contact the insulating strip body. More preferably, the abutment lips are designed to contact the insulating strip body so as to seal the openings in the insulating strip body from the outside environment.

In a further aspect of the present teachings, a composite profile may include first and second window, door or façade frames with at least one insulating strip or strut disposed therebetween for supporting the two frames in a spaced relationship. More preferably, the frames are connected by the insulating strip(s) in a shear-resistant manner, such that the frames remain connected and supported, even if one frame is subjected to a significantly temperature environment than the other frame. The insulating strip is preferably constructed so that a warmer frame is permitted to expand and displace relative to a cooler frame, while avoiding an overall bending or deflection of the assembled composite structural unit. In another embodiment, the insulated strip is preferably constructed in order to apply a spring or elastic force that resists relative longitudinal displacement of the frames, in the event that frames are disposed in different temperature environments. In all embodiments, the insulating strips or struts are designed to minimize or prevent the so-called "bimetal effect", such that the frames of the assembled composite structural unit do not bend, deflect, deviate, etc. when the frames are situated in different temperature environments.

The term "insulating strip" as utilized herein may be substituted or replaced with a variety of other terms, such as insulating bar, isolating strip, isolating bar, separating support, separating bar, insulating strut, isolating strut, separating strut, etc. These various terms may be employed interchangeably unless otherwise indicated. Generally speaking, such structures preferably include the properties of providing a supporting function between two frames, profiles or composite structures and also reduce or minimize heat transfer across the structure when the frames, profiles, composite structures connected thereby are situated in different temperature environments.

In more preferred embodiments, such structures are preferably adapted to resist longitudinal distortion when the respective frames, profiles or composite structures are subjected to differing temperature environments. Thus, when at least one insulating strip according to this aspect of the present teachings is utilized to join or connect, e.g., two metal frames, thereby forming a composite profile, movement of the frames relative to each other in the longitudinal direction can be limited and/or prevented by the high shear-resistance strength of the insulating strip(s). The sheer-resistance can be determined by suitably selecting the characteristics, properties and dimensions of the insulating strips, such as the width, thickness, length, number, etc. of the connecting struts or bridges within each insulating strip, as well as by appropriate selection of the material(s) forming the insulating strip.

In an advantageous manufacturing method, the insulating strips are first formed from a suitable material, e.g., by extrusion, as profiled components having a constant cross section over the entire length. Thereafter, the rungs or struts or bridges of the insulating strip are manufactured to form openings in the insulating strip by a subsequent processing such as machining (e.g. milling), cutting (such as e.g., laser cutting, water jet cutting, etc.), punching, etc. The removed material can be recycled.

Preferably, the components of the unit, e.g., window frames, door frames, façade frames, etc., are firmly and undetachably or permanently connected via the insulating strip(s).

In addition or in the alternative, the intervening spaces or opening between the rungs, struts, bars, etc. of the insulating strip may optionally be filled with a material that has a lower thermal conduction coefficient than the material of the rungs and/or insulating strip.

In addition or in the alternative, the covering profile/element may be electrically-conductive. In this case, the covering profile/element can take on the color of the metal profiles, e.g., by employing a powder coating step to paint the covering profile and/or the assembled composite structural unit. Staining of the insulating profile and/or covering profile/element is also possible.

One advantage of such an embodiment is that k-values (thermal conductivity properties) of the insulating strips are not unduly diminished by the attachment of the covering sheets/covering profiles/fillings, in particular the covering profiles.

Further features and advantages will result from the description of exemplary embodiments with the aid of the figures.

BRIEF DESCRIPTION OF THE DRAWINGS

FIG. 1*a* shows a plan view, FIG. 1*b* shows a cross-sectional view perpendicular to the longitudinal direction along line B-B in FIG. 1*a*, and FIG. 1*c*) shows a cross-sectional view perpendicular to the longitudinal direction along line C-C in FIG. 1*a*.

FIG. 7*a* shows a cross-sectional view perpendicular to the longitudinal direction of the insulating body, FIG. 7*b* shows a cross-sectional view perpendicular to the longitudinal direction of a to-be-clipped-on covering profile, and FIG. 7*c* shows the assembled state of two metal profiles with an insulating strip and covering profile disposed therebetween, in a cross-sectional view perpendicular to the longitudinal direction.

FIGS. 8*a*-8*c* show a sixth embodiment of an insulating strip, wherein FIG. 8*a* shows a plan view perpendicular to the longitudinal direction, FIG. 8*b* shows a cross-sectional view perpendicular to the longitudinal direction, FIG. 8*c* show a modification of the sixth embodiment in a cross-sectional view perpendicular to the longitudinal direction.

FIG. 8*d* shows a seventh embodiment in a plan view perpendicular to the longitudinal direction.

FIG. 8*e* shows an eighth embodiment in a plan view perpendicular to the longitudinal direction.

FIG. 8*f* shows a ninth embodiment in a plan view perpendicular to the longitudinal direction.

FIG. 9 shows a tenth embodiment of an insulating strip, wherein FIG. 9*a* shows a plan view perpendicular to the longitudinal direction and FIG. 9*b* shows a cross-sectional view perpendicular to the longitudinal direction.

FIG. 10 shows an eleventh embodiment of an insulating strip, wherein FIG. 10*a* shows a plan view perpendicular to the longitudinal direction, FIG. 10*b* shows a cross-sectional view perpendicular to the longitudinal direction, FIG. 10*c* shows a modification of the cross-sectional shape perpendicular to the longitudinal direction, FIG. 10*d* shows a cross-sectional view without openings, FIG. 10*e* shows the embodiment of FIG. 10*b* with filling material, and FIG. 10*f* shows the embodiment of FIG. 10*c* with filling material.

DETAILED DESCRIPTION OF THE PREFERRED EMBODIMENTS

Figure 1:
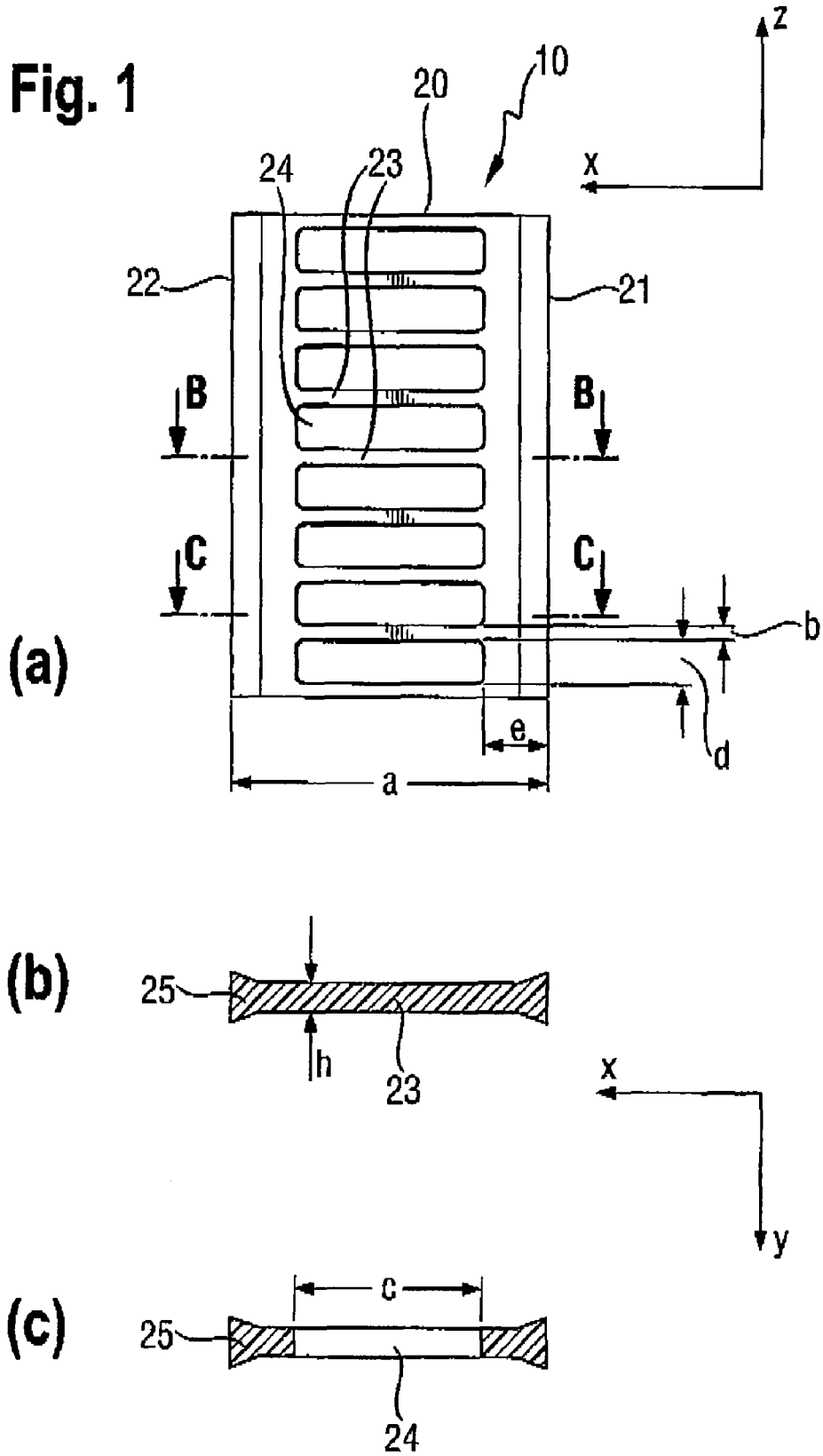
FIG. 1 shows a first embodiment of an insulating strip.
Figure 2:
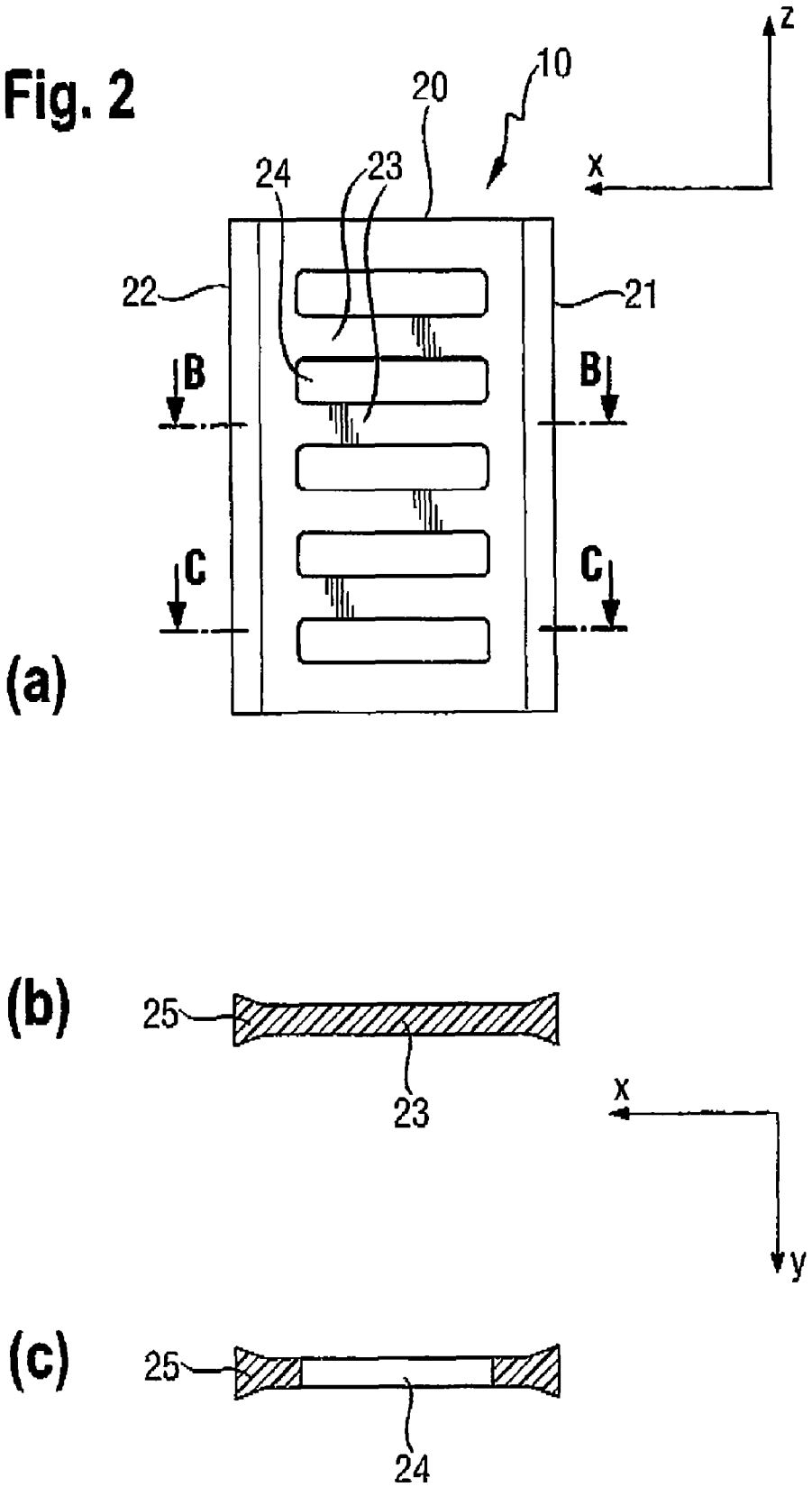
FIGS. 2*a*-2*c* show a second embodiment of an insulating strip having different rung widths in views corresponding to FIG. 1.

In the insulating strips shown in FIGS. 1 and 2, the rungs 23 of a ladder-shaped insulating strip body 20 extend between the continuous longitudinal edges 21, 22 transverse to the longitudinal direction Z. However, the rungs 23 can also extend in an inclined manner (e.g., up to about 20°) relative to the transverse direction. The rungs 23 can also have a curved shape in certain embodiments. Preferably, but not necessarily, all rungs 23 may have the same shape.

In the present disclosure, the rungs 23 may also be referred to as struts, bars, supports, braces, stanchions, stays, etc., which terms are interchangeable in the structures according to the present teachings. In effect, the present teachings are directed to any structure that provides support between two essentially-parallel-extending edges or rails 21, 22 with intervening spaces or openings 24 formed therebetween.

The longitudinal edges or borders 21, 22 are preferably configured or shaped to be fitted with respective profiled components 31, 32 (see FIG. 3) of a composite profile for a shear-resistant connection in the longitudinal direction z. Representative, but not limiting, examples of the profiled components 31, 32 include window, door or façade elements or frames, or any other architectural units, which may comprise metal in certain embodiments. The profiled component may be a composite structure that includes, e.g., a metal frame surrounding a glass insert. In addition or in the alternative, the profiled component may include a wood frame and/or wood insert and/or a plastic frame and/or a plastic insert, etc.

Figure 3:
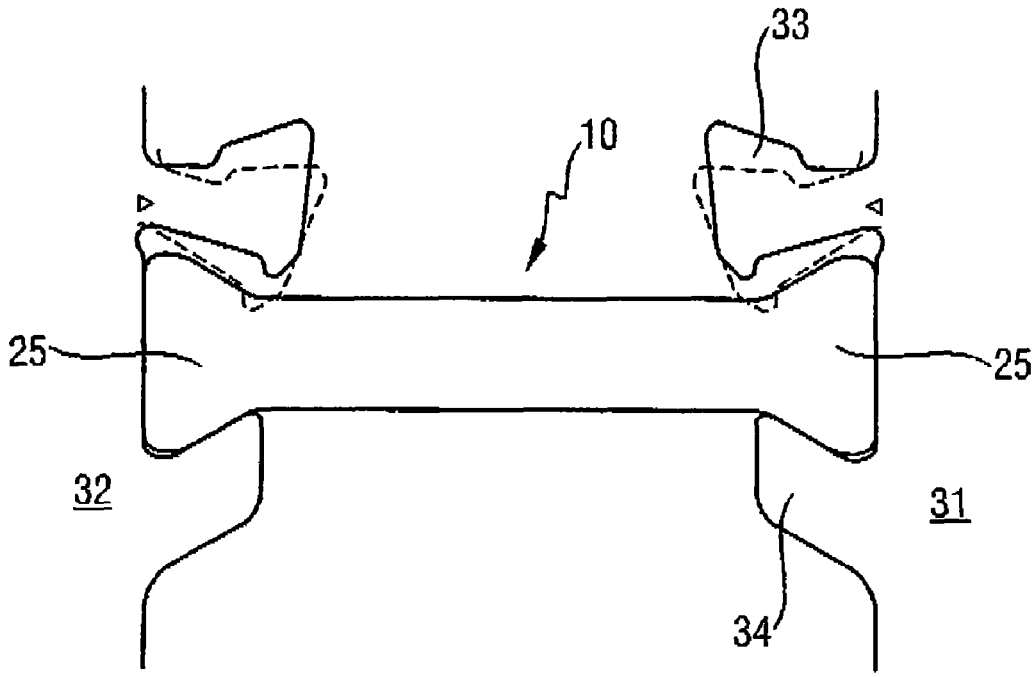
FIG. 3 shows a cross-sectional view perpendicular to the longitudinal direction of an insulating strip when being connected with an inner profile component and an outer profile component by crimping.

In the embodiments of FIGS. 1-3, the longitudinal edges or borders 21, 22 are formed as crimped heads 25 or crimped projections for being crimped within grooves or retainers formed in the profile components 31, 32. The grooves or retainers may be each formed, e.g., by a bendable projection 33 and an opposing wall segment 34. Other types of connections, such as adhering, form-fitting, friction-fitting, etc., are also possible and are within the scope of the present teachings.

In the plan views of FIGS. 1*a* and 2*a*, the rungs 23 have a width b in the longitudinal direction z, which is selected in accordance with the required transverse tensile strength and the required transverse stiffness, as well as the material utilized to form the rungs 23 and the insulating strip body 20. Representative, but not limiting, rung widths b may fall within the range of 0.5 to 10 mm, preferably 1 mm to 5 mm, and more preferably 1 mm to 3 mm.

In a cross-sectional view perpendicular to the longitudinal direction shown in FIGS. 1*b* and 2*b*, the rungs 23 have a height (thickness) h in the y-direction, which also may be selected in accordance with the required transverse tensile strength and the required tensile stiffness, as well as the material utilized to form the rungs 23 and the insulating strip body 20. Representative, but not limiting, rung heights h may fall within the range of 0.5 to 10 mm, preferably 0.5 mm to 5 mm, and more preferably 0.7 to 2 mm.

The rungs 23 are disposed in the longitudinal direction z, preferably but not necessarily with constant intervals or spacings d therebetween. Representative, but not limiting, intervals or spacings d may fall within the range of 1 mm to 100 mm, preferably 1 mm to 50 nm, more preferably 1 mm to 5 mm, and most preferably 1 mm to 3 mm. Naturally, other widths, thicknesses, lengths and intervals are also possible in accordance with the specifications of the intended use of the insulating strip 10.

Test results were obtained based upon ladder-like insulating strips 10 having rungs 23 that, in the plan view in the longitudinal direction of the insulating strip, have a width b of 1 mm for a first embodiment and a width b of 3 mm for a second embodiment and, in the longitudinal direction of the insulating strip, each have constant intervals d of 3 mm. In the plan view in the transverse direction to the longitudinal direction of the insulating strip, the openings 24 had a length c of about 14 mm with an overall size or width a of the insulating strip 10 in the x-direction of about 23 mm. These insulating strips exhibited values for the transverse tensile strength (tension in the direction of the connection of the profile components connected by the insulating strip, i.e. the x direction in FIGS. 1 and 2), which were higher for both rung widths than for comparable profiles according to DE 199 56 415 C1. In addition, the sheer-resistance (relative displacement of the profile components connected by the insulating strip in the longitudinal direction z of the profile components, i.e. in the longitudinal direction z in FIGS. 1 and 2) could be adjusted simply by setting the rung width to values below or above the values for comparable profiles according to DE 199 56 415 C1. Consequently, the amount of the longitudinal displaceability is easily tailorable for a very high transverse tensile strength. These strips were designed to provide a limited longitudinal displaceability in order to reduce the problem of the "bimetal effect" discussed above in the Background section.

Figure 4:
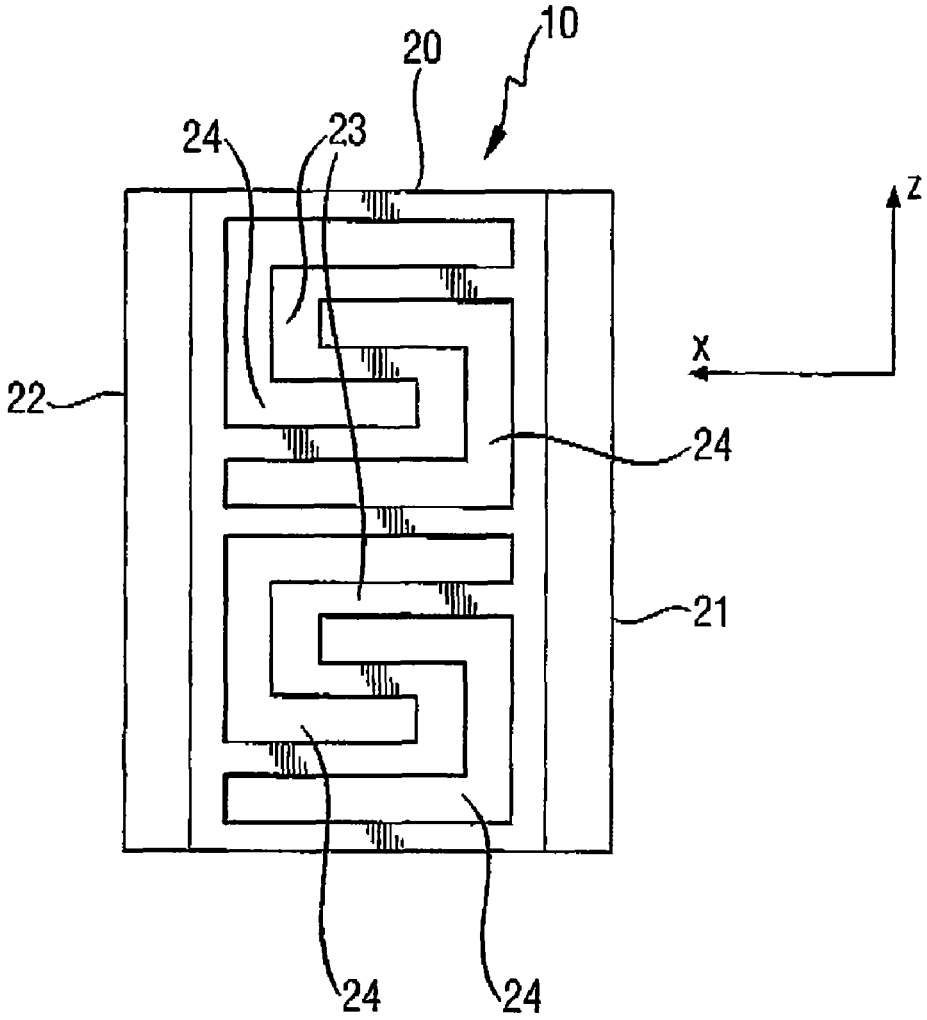
FIG. 4 shows a third embodiment of an insulating strip having meander-shaped rungs in a ladder-like structure.

FIG. 4 shows a third embodiment of an insulating strip 10 with meander-shaped rungs 23 of the ladder-like structure in a view corresponding to FIG. 1*a*, wherein the same reference numerals represent the same structures as FIGS. 1-3. This embodiment is also capable of minimizing relative longitudinal displacement between frames of a window, door, façade, etc.

Figure 5:
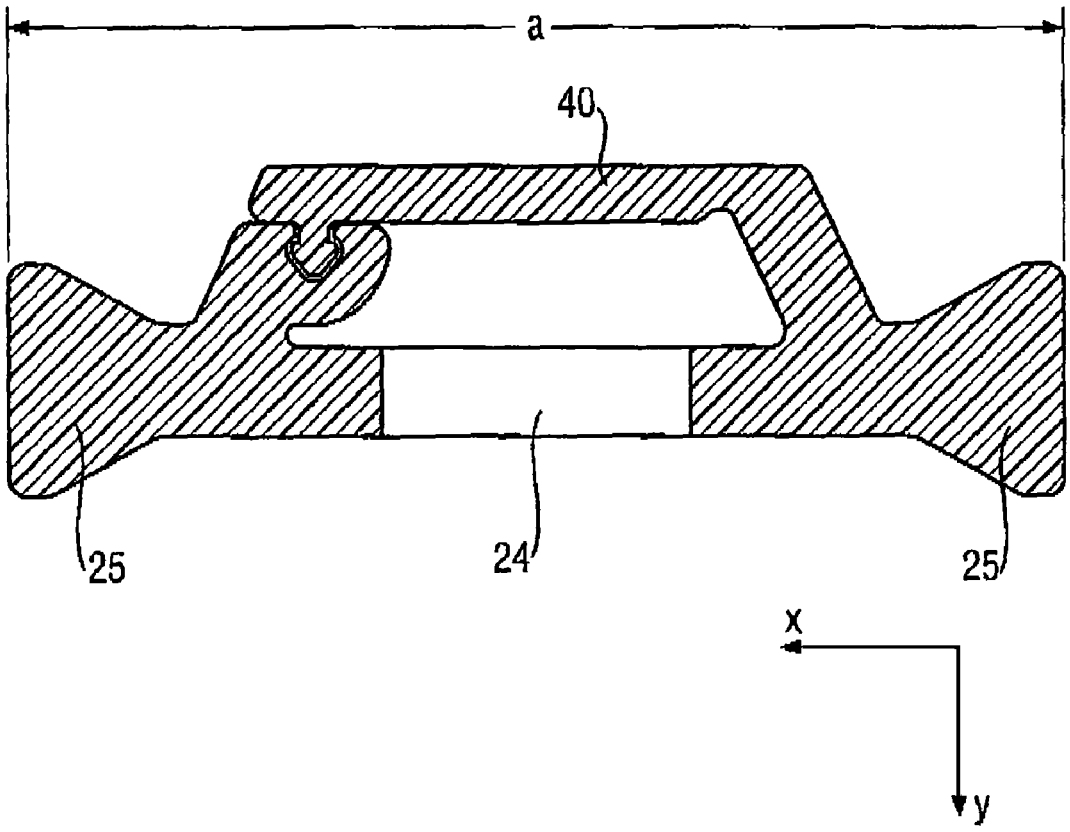
FIG. 5 shows a fourth embodiment of an insulating strip having an in situ extruded cover, which view corresponds to FIG. 1*c*.

In the fourth embodiment of an insulating strip shown in FIG. 5, an in situ extruded cover or covering profile 40 is provided for covering the intervening spaces 24 between the rungs 23. The embodiment of FIG. 5 is shown in a view similar to FIGS. 1*c* and 2*c* and may be mounted between profiled components 31, 32 by crimping the crimping heads 25 in the manner shown in FIG. 3.

The covering profile 40 of FIG. 5 is integrally formed, e.g., by in situ extruding it with the insulating strip body 20. In the cross-sectional view perpendicular to the longitudinal direction z shown in FIG. 5, the covering profile 40 is extruded so as to extend from one side of the rungs 23 as viewed in the x-direction. The free or terminal end (edge) of the covering profile 40 is clipped onto the other side of the rungs 23 as viewed in the x-direction. The clip connection is formed such that the clipping takes place in the height-direction, i.e. the y-direction.

The structure of the connecting arrangement may be selected according to the specifications for the intended use of the insulating strip. For example, in FIG. 5, a snap-fit connection is shown, wherein the covering profile 40 includes a clipping head that elastically-resiliently fits into a clipping retainer formed adjacent the crimping head 25. However, other types of snap-fit, form-fit, friction-fit connections are possible, as well as other types of connections, such as adhesives, fasteners, etc. are within the scope of the present teachings. In the embodiment of FIG. 5, it only significant that the covering profile 40 is integrally manufactured with the insulating strip body 20 and then is bent or folded over so as to cover the openings 24. The form or type of the connection for holding the covering profile 40 in the position covering/protecting the openings 24 is not particularly limited.

Figure 6:
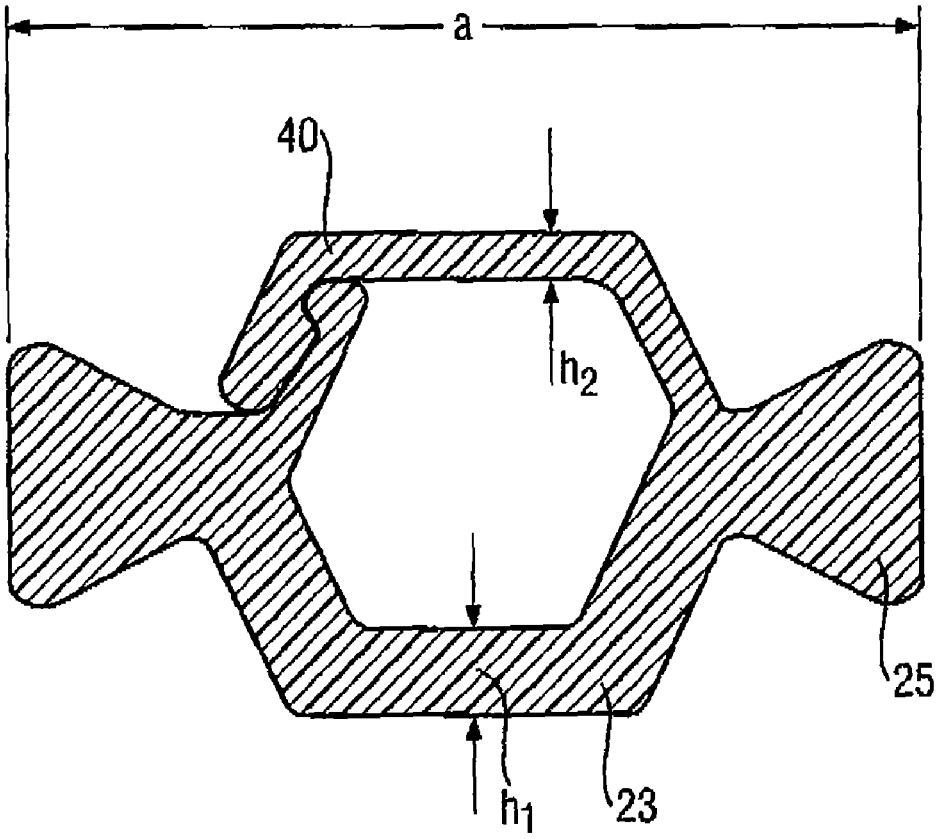
FIG. 6 shows a modification of the fourth embodiment of FIG. 5.

In an alternative embodiment shown in FIG. 6, the clip connection is formed differently, such that the clipping takes place inclined to the height-direction (y-direction) and a traction force in the transverse direction (x-direction) holds the clip in engagement. In this embodiment, the covering profile 40 is shown extending over a rung 23 and the rung 23 may have a different thickness or height $h_1$ than the thickness or height $h_2$ of the covering profile 40.

In the fifth embodiment shown in FIG. 7*a*, clip heads 28, e.g., male clip components, may be provided on one or more rungs 23 of the insulating strip body 20. As a representative, non-limiting example, the clip heads 28 may be disposed such that, in the height-direction y, one clip head 28 is disposed on one side and two clip heads 28 are disposed on the other side of the body 20. The single clip head 28 may be disposed centrally on the rung 23 in the transverse direction x, while the two other clip heads 28 on the other side may be disposed at an identical distance from the center. However, various other arrangements of the clip heads 28 may be utilized, as will be apparent from the following teachings.

In FIG. 7*b*, a cover or covering profile 40 may be provided, e.g., with three clip retainers 48, e.g., female clip components. The two outer clip retainers 48 may be provided at the same distance as the two clip heads 28 located on one side of the insulating strip body 20. The third clip retainer 48 is disposed centrally between the outer clip retainers 48.

As is readily apparent from FIGS. 7*a*-7*c*, a cover or covering profile (element) 40 can be clipped onto one or both sides of the insulating strip body 20 without the need for providing differently-configured covers 40. However, if desired, it is also within the present teachings to provide two different covers 40, each having different numbers or arrangements of clip retainers 48. Naturally, it is also within the present teachings to provide the clip head(s) 28 on the cover 40 and the clip retainer(s) 48 on the insulating strip body 20. Moreover, although a snap-fit connection is shown herein as an exemplary embodiment, other forms of connections are possible, as were discussed above.

The insulating strip body 20 may have a substantially constant thickness $h_1$ over its width $a_1$ in the transverse direction x. The width $a_2$ of the cover 40 in the transverse direction x may preferably be less than or equal to the width $a_1$ of the insulating strip body 20. In this preferred embodiment, the edges of the cover 40 may also include two abutment lips 42 formed substantially in the transverse direction x and extending substantially in the longitudinal direction Z. The clip retainers 48 may be formed to have a recess of depth $h_4$ in the height-direction y, as measured from the base of the clip retainer 48 to the outermost tip of the clip retainer 48. The depth $h_4$ is preferably less than the height $h_3$ of the clip heads 28. The lips 42 end in the height-direction y at the peak or terminal end of the clip retainers 48 or somewhat higher, as shown e.g., in FIG. 7*c*.

In addition, as shown in FIG. 7*c*, the abutment lips 42 may extend from the body 41 of the cover 40 at an angle, e.g., of between 90-135°, more preferably between 100-120°. The ends of the abutment lips 42 may preferably contact and form a seal between the cover 40 and the insulating strip body 20 when connected thereto.

Although the cover 40 is preferably detachably coupled to the insulating strip body 20, it may also be permanently or fixedly connected to the insulating strip body 20 in certain embodiments of the present teachings. It is simply preferable that the cover 40 serves to cover and/or seal the openings 24 from the outside environment, so that moisture and/or dirt do not penetrate into the interior cavity of the fully-assembled composite structure, e.g., a double-pane window unit, door unit, etc.

Preferably, synthetic material having a Young's modulus value greater than 2000 $N/mm^2$ is used to form the insulating strip 10. Suitable synthetic materials include, but are not limited to, polyamides, polyesters or polypropylenes, e.g., PA66 (Polyamide 66). The covering profile 40 may optionally be formed from a different material than the insulating strip body 20.

The thickness $h_1$ of the insulating strip bodies 20 of all embodiments may optionally fall within the range of 1 mm to 50 mm, preferably 1 mm to 10 mm, more preferably 1 mm to 2 mm, even more preferably 1.4 to 1.8 mm, although other thicknesses may be appropriate for certain embodiments of the present teachings. The thickness $h_2$ of the cover 40 is preferably less than or equal to the thickness $h_1$ of the associated insulating strip body 20, although other thicknesses may be utilized, as desired.

The embodiment shown in FIGS. 5 and 6 is well-suited for smaller values of the width a of the insulating strip body 20, e.g., in the range of 8 to 20 mm, more preferably, 14 mm. In such embodiments, the thickness $h_1$ preferably is, for example, in the range of 1-3 mm, more preferably about 1.4 mm.

Figure 7:
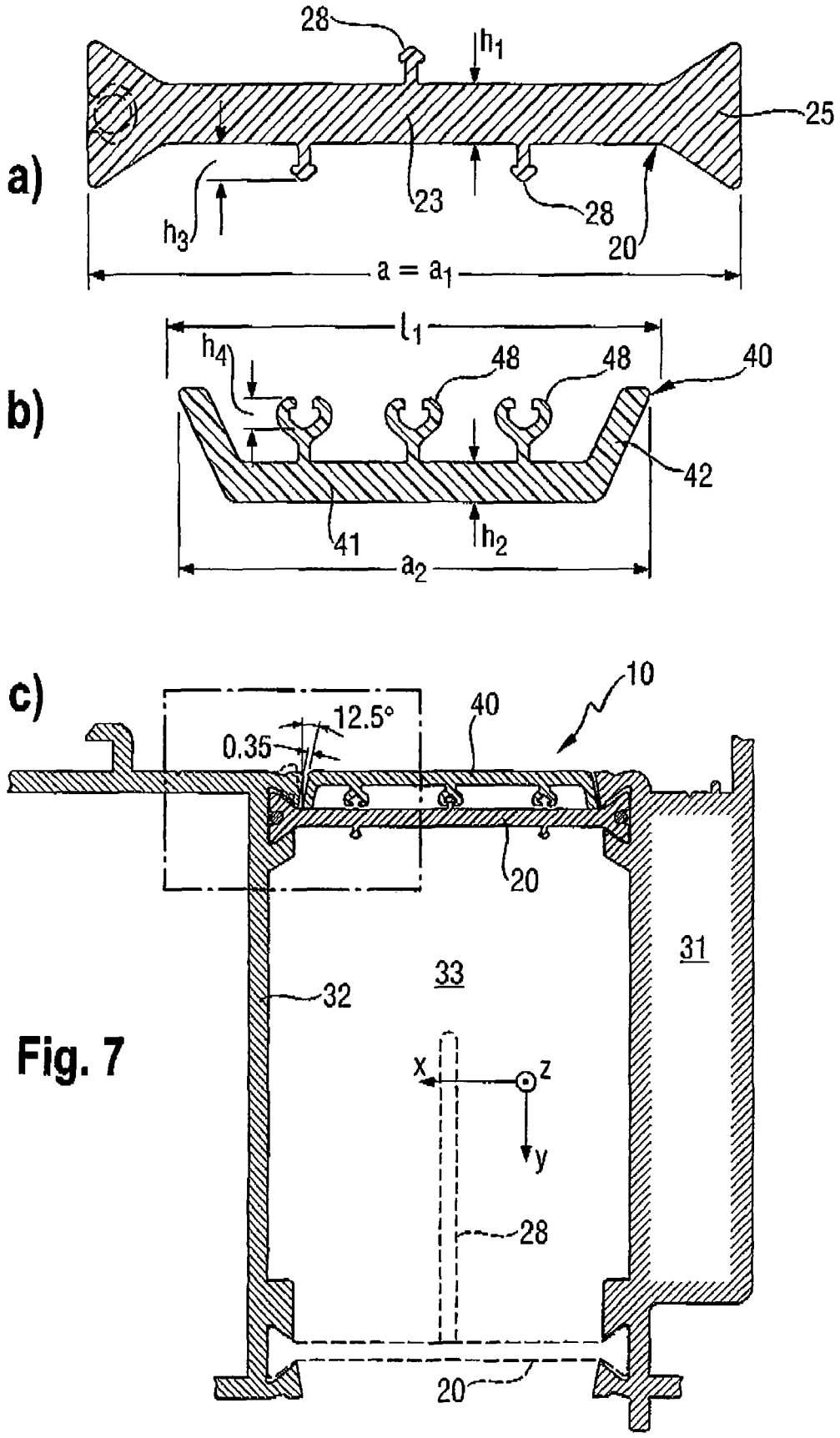
FIG. 7 shows a fifth embodiment of an insulating strip.

The embodiment according to FIG. 7 is well-suited for values of the width a of the insulating strip body 20, e.g., in the range of 20 to 40 mm, more preferably, 32 mm. In such embodiments, the preferred thickness $h_1$ is in the range of 1.5 to 1.8 mm. PA66 is the preferred material for the indicated widths and material thicknesses.

In one aspect of the present teachings, the insulating strip body 20 may consist only of synthetic material. That is, it may be formed without a metal insert. However, a metal insert also may be included in the insulating strip body 20, if desired.

FIG. 8*a* shows another embodiment of the present teachings, which is designed with an eye towards improved shear strength and is illustrated in a plan view perpendicular to the longitudinal direction. The insulating strip 10 may have a width a in the x-direction in the range of about 10 mm to about 100 mm. A plurality of openings 24 preferably penetrate through the insulating strip body 20 in the height-direction (thickness-direction) y. In FIG. 8*a*, the openings 24 have a substantially triangular shape in the plan view and the corners of the triangles are rounded so as to have a radius R. The triangles also have a height c in the transverse direction x.

The triangles may be arranged in an alternating manner, such that, in the plan view in FIG. 8*a*, a lateral side of one triangle is alternately arranged in parallel next to the left side, then to the right side, then again to the left side, etc. Consequently, the vertices of the triangles are also arranged in an alternating manner. Rungs 23 are located between the triangles and have a width b perpendicular to the sides of the bordering triangles. The triangles are separated from the respective outer longitudinal edges 21, 22 in the transverse direction x by a distance or length e. Thus, it follows that a=c+2e.

The insulating strip 10 has a constant height (thickness) h in the height-direction y over its entire width, except for the crimping heads 25, which may be thicker. Preferred values are provided as follows. For insulating strips 10 having a width a less than 22 mm, c preferably falls within the range of 7 to 10, more preferably about 8 mm. In such embodiments, the radius R is preferably less than 2 nm, more preferably less than 1 mm, and even more preferably about 0.5 mm. Such a radius serves to avoid a concentration of stress or the formation of a type of bending joint. The width b of the rungs 23 is preferably 1 to 3 mm, more preferably 2 mm.

For insulating strips 10 having a width a greater than or equal to 22 mm, c preferably falls within the range of 8 to 18 nm, more preferably about 12 mm. The height h in the height-direction y is preferably 1.2 to 2.4 mm, more preferably about 1.8 mm. The strip 10 is preferably formed of PA66 GF25.

FIG. 8*c* shows a modification of the sixth embodiment in a cross-sectional view, wherein the progression of the strip between the two crimping heads 25 is not linear, as in FIG. 8*b*, but rather is crooked or bent in the x-direction.

FIG. 8*d* shows a seventh embodiment that differs from the sixth embodiment in that the openings 24 are not substantially triangular, but rather are substantially rectangular. The cross-section of the insulating strip body 20 perpendicular to the longitudinal direction can be the same as depicted as in FIG. 8*b* or 8*c*. The dimensions for a, b, c, e or R indicated above for the sixth embodiment also apply to the seventh embodiment. The dimension d, i.e., the extension or length of the openings 24 in the longitudinal direction z preferably falls within the range of 3 to 8 mm, more preferably about 5 mm. This dimension d also applies to the preferred maximal extension or length of the triangular openings 24 of the sixth embodiment, although the dimension d is not shown in FIG. 8*a*.

FIG. 8*e* shows an eighth embodiment that differs from the sixth and seventh embodiments, in that the openings are circular with a diameter C. FIG. 8*f* shows a ninth embodiment that differs from the sixth and seventh embodiments, in that the openings are hexagonal. The remaining specifications for the sixth and seventh embodiments also apply to the eighth and ninth embodiments, as far as they are applicable.

Figure 9:
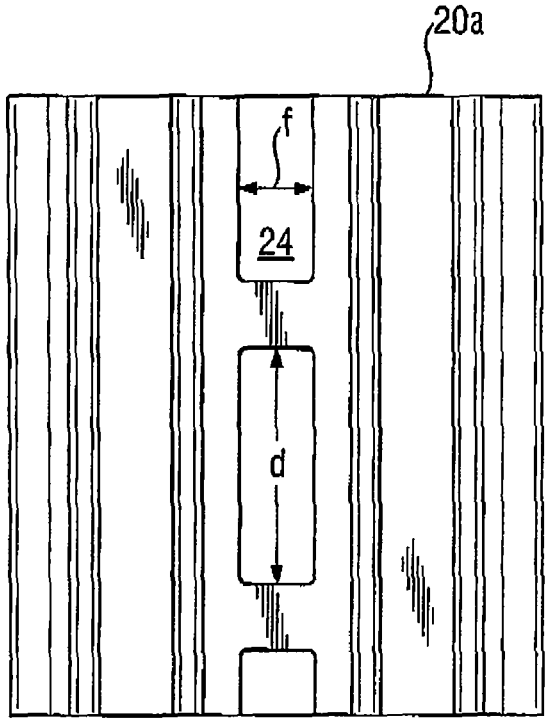
Figure 9:
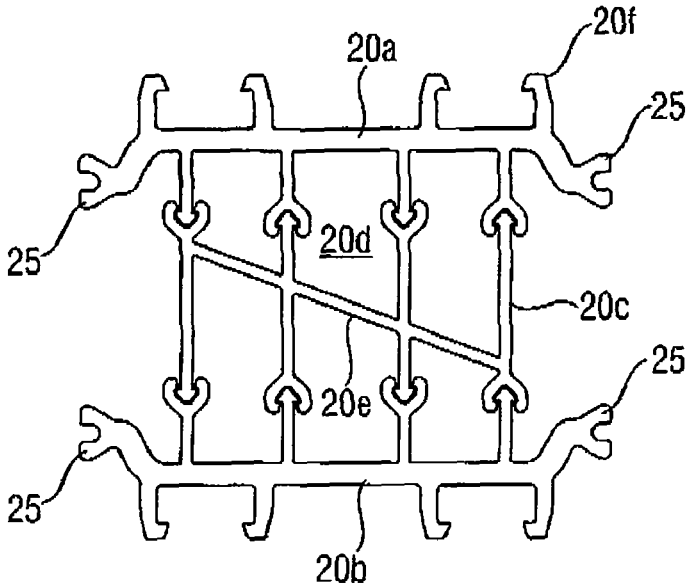
Figure 11:
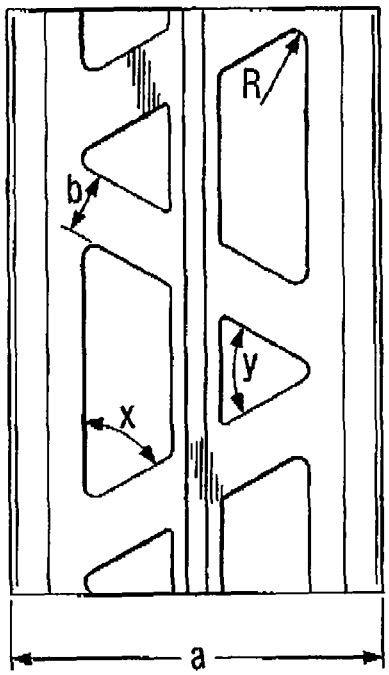
FIGS. 11*a*-11*f* show modifications of the sixth to ninth embodiments in views corresponding to FIG. 8.
Figure 11:
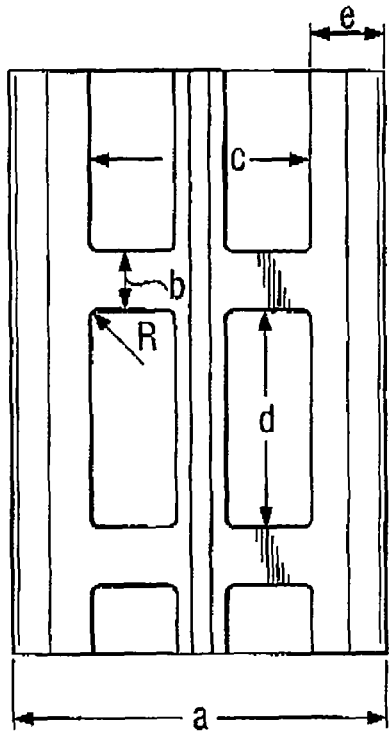
Figure 11:
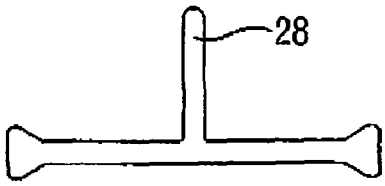
Figure 11:
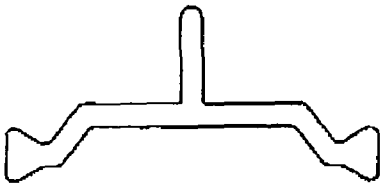
Figure 11:
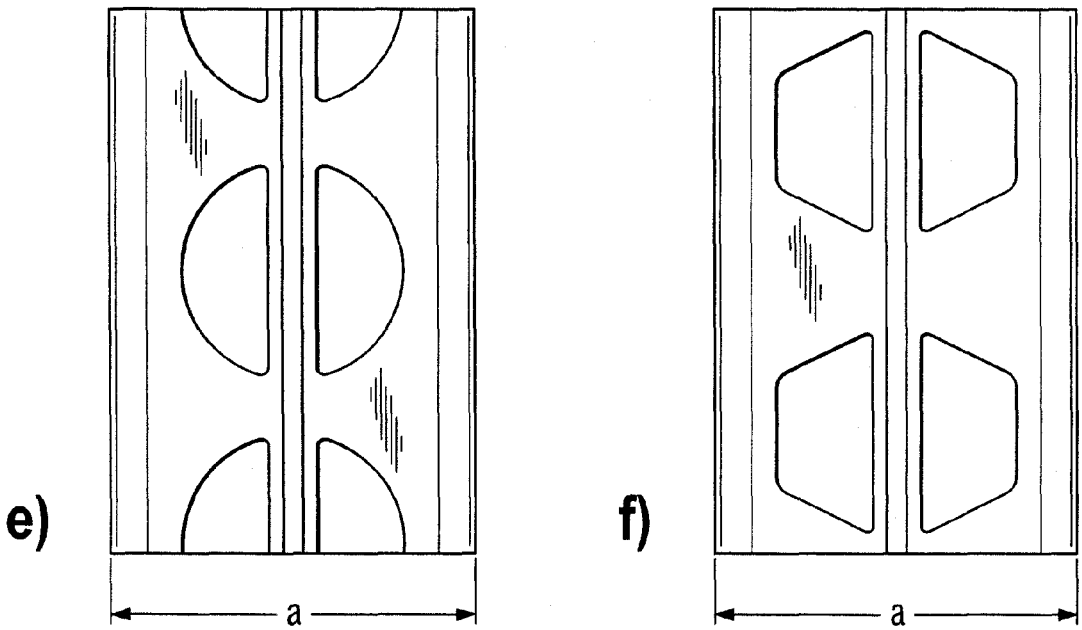
Figure 12:
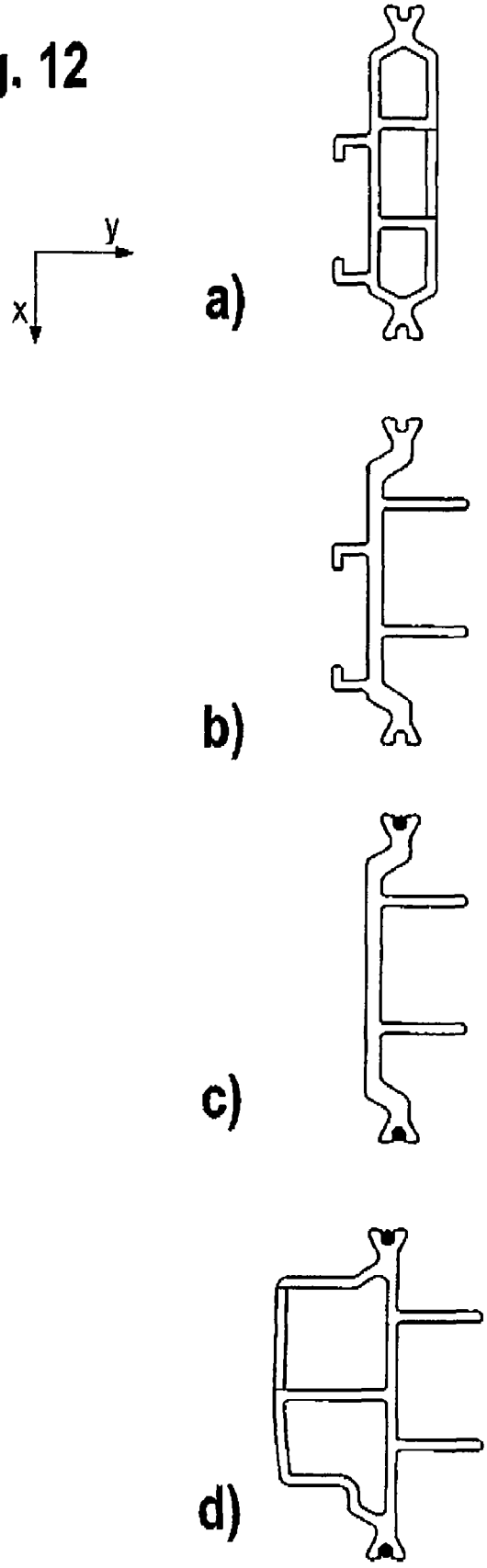
FIG. 12*a* shows a modification of the embodiments of FIGS. 10*a* and 10*c*.
FIGS. 12*b* and 12*c* show modifications of the embodiments of FIGS. 8 and 11, respectively.
FIG. 12*d* shows a modification of the embodiment of FIG. 10.

FIG. 9 shows an insulating strip having a so-called "package-design", FIG. 9*a* shows the plan view perpendicular to the longitudinal direction and FIG. 9*b* show a cross-sectional view relative to the longitudinal direction. This package-design is intended to be assembled in a composite profile, such as is shown in an exemplary manner in cross-section in FIG. 7*c*.

In this embodiment, four crimping heads 25 are crimped in the four corresponding retainers or grooves of the profiled components (e.g., metal frames), as is readily apparent from a comparison with FIG. 7. To achieve this connection to the profiled components, the upper insulating strip portion 20*a* shown in FIG. 9*b* is crimped upwards (as compared with FIG. 7*c*) and the lower insulating strip portion 20*b* in FIG. 9*b* is crimped downwards (as compared with FIG. 7*c*). The two insulating strip portions 20*a*, 20*b* are connected by a clipped-on (snap-fit) connecting piece 20*c*. This embodiment provides, on the one hand, a shielding against convection and radiation between the inner and outer sides of the composite profile and, on the other hand, a plurality of hollow chambers 20*d* is formed. The hollow chambers 20*d* are divided in the height-direction y by a diagonal strut 20*e* of the connecting piece 20*c*.

As can be seen in FIG. 9*a*, the openings 24 have a width f in the transverse direction x and a longitudinal extension or length d in the longitudinal direction Z and can be formed in one or more insulating strip components 20*a*, 20*b* and/or in the connecting piece 20*c*. Each insulating-strip component 20*a* and 20*b* shown in FIG. 9*b* also has outwardly-directed protrusions 20*f* that can form retainers, e.g., for rubber sealing elements and/or mounting components. However, the protrusions 20*f* are optional components of the illustrated embodiment. The number of openings 24 and the width and length of the openings 24 are not limited to the arrangement shown in FIG. 9*a* and may be freely selected by the designer.

FIG. 10 shows another embodiment of the present teachings, which will be referred to herein as a "hollow-chamber profile". In such a hollow-chamber profile, hollow chambers are located in the transverse direction x between the crimping protrusions 25. For comparison purposes, the cross-section of a conventional hollow-chamber profile is shown in FIG. 10*d*. As is readily apparent from a comparison with the cross-section of the eleventh embodiment in FIG. 10*b*, the difference is, in essence, that a wall is removed from the central hollow-chamber between the rungs 23, thereby forming an opening 24. The openings 24 have a width g in the transverse direction x and a longitudinal extension or length d in the longitudinal direction z.

In particular for hollow-chamber profiles having a width a greater than or equal to 25 mm, g preferably falls within the range of about 8 to 18 mm, more preferably about 12 mm. With the modifications shown in FIG. 10*c*, an opening 24 is formed only on one side of the hollow-chambers. In accordance with the modifications shown in FIGS. 10*e* and 10*f*, the part of the hollow chamber profile, in which one or more openings 24 are formed, is filled with foam that serves as a filling material. This foam preferably is pure foam having a lower thermal conductance coefficient than the material forming the insulating strip body 20. The other specifications noted above for, e.g., values a, b, d and R may be likewise utilized for this embodiment. The thicknesses $h_5$ and $h_6$ may be the same or different.

Figure 8:
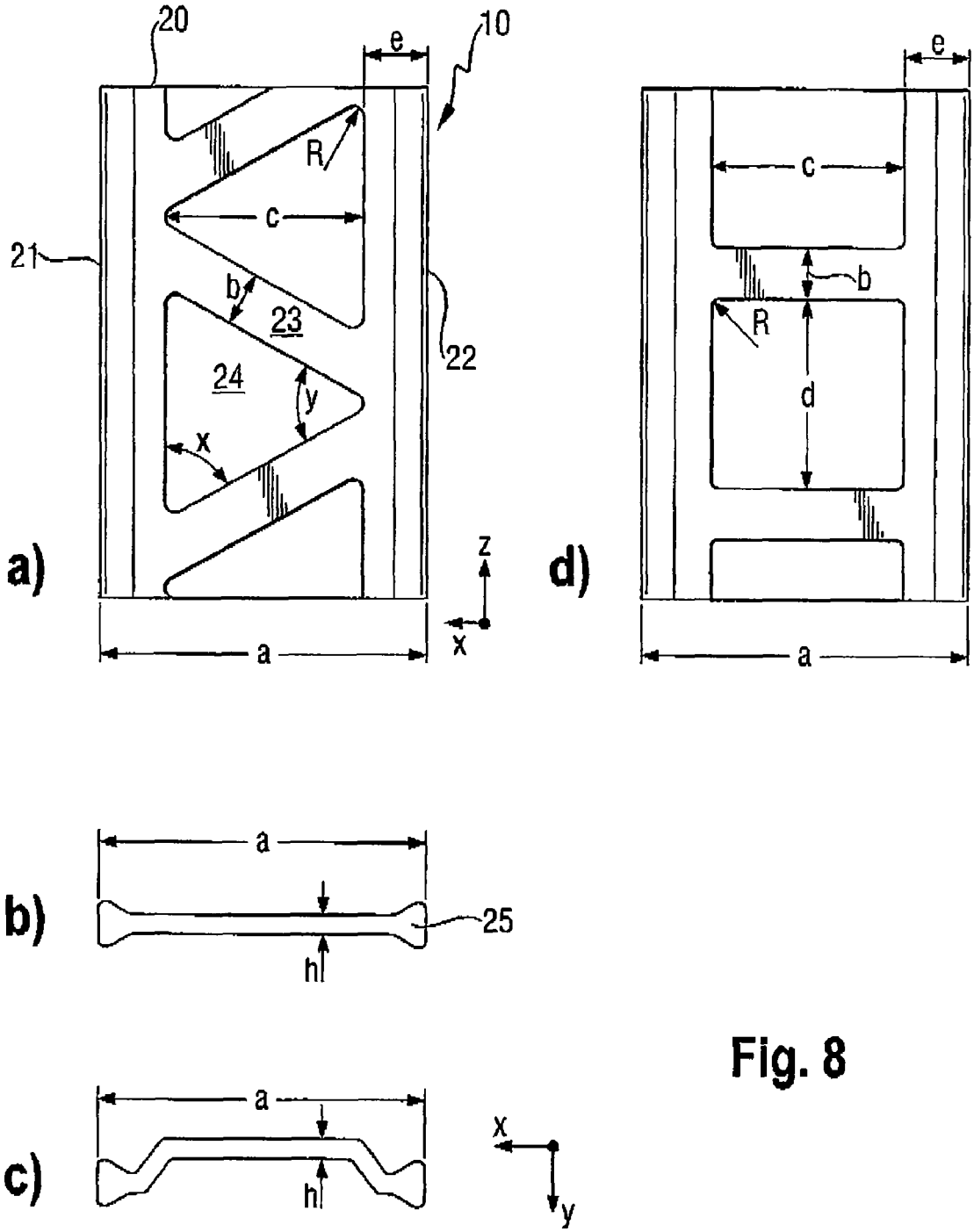
Figure 8:
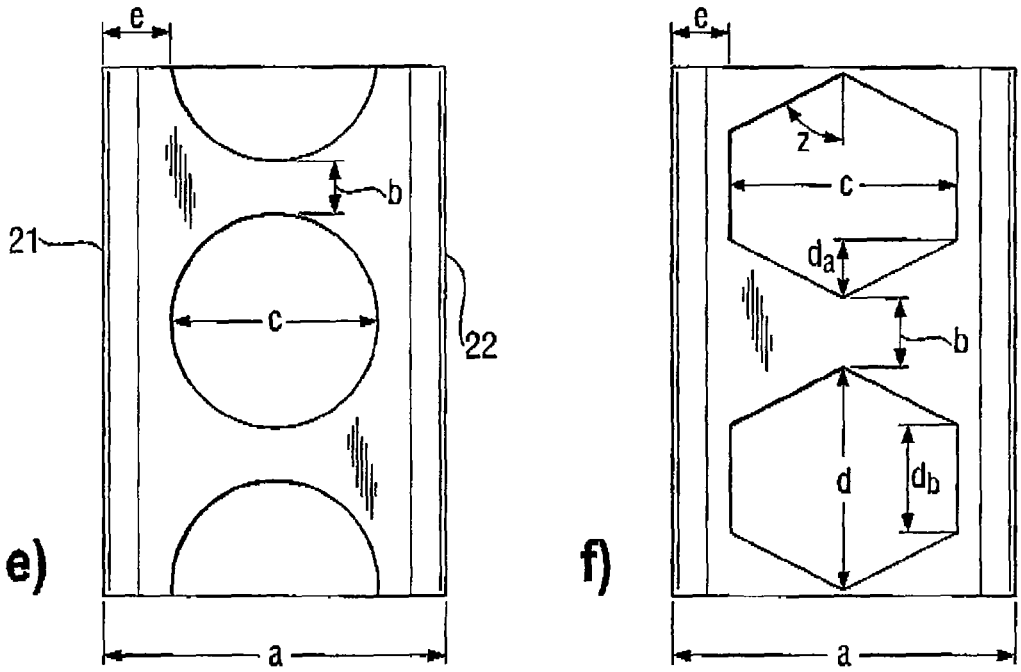

FIGS. 11*a* to 11*f* show modifications of the sixth to ninth embodiments in views with the same numbering a to f as FIG. 8, wherein a projection 28 is formed on each insulating strip body 20. This projection 28 protrudes from the insulating strip body 20 substantially in the height direction y and may preferably serve to obstruct convection and radiation. The height of the protrusion 28 in the height-direction y is chosen to achieve this effect. In FIG. 7*c*, the installation of an insulating strip 10 having such a protrusion 28 is indicated by broken lines. An especially-effective obstruction of the convection and radiation is achieved when the above-described insulating strip 10 shown in FIG. 7*c*) has one or more corresponding protrusions 28 that overlap with the lower protrusion 28 as viewed in the transverse direction x. FIGS. 12*a-d* show modifications of insulating strips having two such protrusions 28.

All embodiments shown in FIGS. 8 to 12 are preferably provided either with an in situ extruded cover of the type shown in FIGS. 5 and 6 or with clip-protrusions and/or clip retainers of the type shown in FIG. 7. In the alternative, it is also possible to provide sheets or films for covering the openings or to introduce a foam into hollow-chambers of the insulating strip body 20, which foam preferably comprises a material that is less heat conductive than the material of the insulating strip bodies.

Suitable materials for the insulating-strip bodies 20 are rigid-PVC, PA, PET, PPT, PA/PPE, ASA, PA66, wherein PA66 GF25 is preferred. Suitable foams are preferably selected from thermosetting materials such as polyurethane, and more preferably the foam has a relatively low density, such as about 0.01 to 0.3 kg/l.

Previous applications of ladder-like profiles were aimed at achieving low shear strength (high longitudinal movability). In one other application, openings were provided only to reduce the heat conductance of a metal insert known to be extremely conductive.

With the preferred embodiments having one or more at least partly in situ extruded covers clipped onto one side of the insulating strip body, more preferably entirely clipped-on covers, as well as embodiments having adhered or laminated sheets for covering the openings, it has been surprisingly found, in particular for the entirely or partly clipped-on covers, that these covers only marginally influence the k-values, i.e. the heat-isolation characteristics of the insulating strip, as compared to non-covered versions.

Tests with a solid strip having a cross-section of the type shown in FIG. 5*b*, i.e. with a strip having no openings, which strip has a width of 25 mm and a height h of 1.8 mm and is made from PA26GF25, have resulted in a k-value ($W/m^2K$) of 2.4. An insulating strip of the type shown in FIG. 8*d*, in which c is 8 mm and d is 2 mm and without a cover, resulted in a k-value of 2.15 $W/m^2K$. A corresponding strip with a clipped-on cover according to FIG. 7 had a k-value of 2.25 $W/m^2K$. These measurements were performed in a so-called "hot-box", wherein a system having 25 mm wide, flat insulating strips was used as the initial system; the strips were not exchanged during the course of the test. Therefore, the improvements of the k-values are expected to be even better in reality.

Although the cause of this effect has not yet been conclusively ascertained, it is presumed that it lies in the form of the clip connections, which severely restrict or narrow the heat transmission path through the cover.

For the embodiments having hollow chambers shown in FIGS. 9 and 10, which have already been tested in systems with very good insulating properties, these properties can be further improved. The use of convection- and/or radiation-shielding protrusions 28 also increases the effect.

Each of the various features and teachings disclosed above may be utilized separately or in conjunction with other features and teachings to provide improved insulating strips, and composite structures incorporating such insulating strips, as well as methods for designing, manufacturing and using the same. Representative examples of the present invention, which examples utilize many of these additional features and teachings both separately and in combination, were described above in detail with reference to the attached drawings. This detailed description is merely intended to teach a person of skill in the art further details for practicing preferred aspects of the present teachings and is not intended to limit the scope of the invention. Therefore, combinations of features and steps disclosed in the detailed description may not be necessary to practice the invention in the broadest sense, and are instead taught merely to particularly describe representative examples of the present teachings.

Moreover, the various features of the representative examples and the dependent claims may be combined in ways that are not specifically and explicitly enumerated in order to provide additional useful embodiments of the present teachings. In addition, it is expressly noted that all features disclosed in the description and/or the claims are intended to be disclosed separately and independently from each other for the purpose of original disclosure, as well as for the purpose of restricting the claimed subject matter independent of the compositions of the features in the embodiments and/or the claims. It is also expressly noted that all value ranges or indications of groups of entities disclose every possible intermediate value or intermediate entity for the purpose of original disclosure, as well as for the purpose of restricting the claimed subject matter.

The contents of U.S. Pat. Nos. 5,313,761, 5,675,944, 6,038,825, 6,068,720 and 6,339,909 and US Patent Publication Nos. 2005-0100691 and 2005-0183351 provide additional useful teachings that may be combined with the present teachings to achieve additional embodiments of the present teachings, and these patent publications are hereby incorporated by reference as if fully set forth herein.

The invention claimed is:

1. A composite structure comprising:

a first frame, a second frame, and at least one insulating strip made of plastic and supporting the first and second frame in a spaced relationship, the insulating strip comprising:

a body extending in a longitudinal direction and having at least first and second longitudinal edges separated by a distance in a transverse direction, the first longitudinal edge being fixedly connected with the first frame by one of a crimped connection and a rolled-in connection in a shear-resistant manner and the second longitudinal edge being fixedly connected with the second frame by one of a crimped connection and a rolled-in connection in a shear-resistant manner, wherein a plurality of openings penetrate through one or more walls of the body in a height-direction thereof, the openings being separated from each other in the longitudinal direction of the body by one or more struts, the body further comprises at least one attachment structure configured to retain a covering profile, which is an integral part of the insulating strip body, configured to cover the openings and to prevent moisture or dirt from penetrating into a gap defined between the first and second frames, the covering profile is configured to be folded or bent over the insulating strip body so as to cover one side of the openings in the transverse direction and to detachably clip onto the insulating strip body so as to secure the covering profile in the opening-covering position;

the covering profile includes a clipping head that elastically-resiliently fits into a clipping retainer formed adjacent the first longitudinal edge of the insulating strip body, the covering profile being integrally connected to the insulating strip body adjacent the second longitudinal edge of the insulating strip body;

the insulating strip body has a width in the transverse direction of between 8-100 mm and a thickness across the struts of one of (i) between 1-2 mm for an insulating strip body width less than 22 mm and (ii) between 1.2-2.4 mm for an insulating strip body width greater than or equal to 22 mm and the insulating strip body comprises two or more struts having a width in the longitudinal direction of between 1-3 mm and being spaced at constant intervals of between 1-5 mm.

2. The composite structure according to claim 1, wherein the insulating strip body width in the transverse direction is between about 8 mm to 20 mm.

3. The composite structure according to claim 2, wherein the struts are flexible and enable the first longitudinal edge to displace relative to the second longitudinal edge in the longitudinal direction when the first and second longitudinal edges are subjected to different temperature conditions.

4. A composite structure comprising:

a first frame, a second frame, and at least one insulating strip made of plastic and supporting the first and second frame in a spaced relationship, the insulating strip comprising:

a body extending in a longitudinal direction and having at least first and second longitudinal edges separated by a distance in a transverse direction, the first longitudinal edge being fixedly connected with the first frame by one of a crimped connection and a rolled-in connection in a shear-resistant manner and the second longitudinal edge being fixedly connected with the second frame by one of a crimped connection and a rolled-in connection in a shear-resistant manner, wherein at least three openings penetrate through one or more walls of the body in a height-direction thereof, the openings being respectively separated from each other in the longitudinal direction of the body by at least two struts extending from the first longitudinal edge to the second longitudinal edge, a covering profile integrally extends from the body and is configured to cover the openings so as to prevent moisture or dirt from penetrating through the openings into a gap defined between the first frame and the second frame, the covering profile being disposed on a side of the insulating strip body that is opposite of the gap between the first and second frames, and at least one attachment structure is integrally disposed on the body and is configured to retain a terminal end of the covering profile.

5. A composite structure according to claim 4, wherein the at least one attachment structure comprises a structure selected from a clip head projecting from at least one side in the height-direction and a clip retainer having a recess extending in the height-direction.

6. A composite structure according to claim 5, wherein the covering profile is configured to be folded or bent over the insulating strip body so as to cover one side of the openings in the transverse direction and to detachably clip onto the at least one attachment structure so as to secure the covering profile in the opening-covering position.

7. A composite structure according to claim 6, wherein the insulating strip comprises polyamide and the first and second frames comprise a metallic material.

8. A composite structure according to claim 7, wherein the struts have a width in the longitudinal direction of between about 0.5 mm and 10 mm.

9. A composite structure according to claim 8, wherein the struts have a width in the longitudinal direction of between about 1 mm and 3 mm.

10. A composite structure according to claim 8, wherein the struts are spaced at constant intervals falling within a range of about 1 mm to 5 mm.

11. A composite structure according to claim 10, wherein the struts are spaced at constant intervals falling within a range of about 1 mm to 3 mm.

12. A composite structure according to claim 11, wherein the covering profile includes a clipping head that elastically-resiliently fits into a clipping retainer formed adjacent the first longitudinal edge of the insulating strip body, the covering profile being in situ extruded with the insulating strip body and extending from a position adjacent the second longitudinal edge of the insulating strip body.

13. The composite structure according to claim 12, wherein the insulating strip body has a width in the transverse direction of between about 8 mm to 20 mm.

14. The composite structure according to claim 13, wherein the struts are flexible and enable the first longitudinal edge to displace relative to the second longitudinal edge in the longitudinal direction when the first and second longitudinal edges are subjected to different temperature conditions.

15. An insulating strip made of plastic and configured for supporting two profiles in a spaced relationship, comprising:

a body extending in a longitudinal direction and having at least first and second longitudinal edges separated by a distance in a transverse direction, the longitudinal edges being configured to be connected with the respective profiles by one of crimping and rolling-in in a shear-resistant manner, wherein a plurality of openings penetrate through one or more walls of the body in a height-direction, the openings being separated from each other in the longitudinal direction of the body by a plurality of struts, a covering profile integrally extending from the insulating strip body and being configured to cover the openings and at least one attachment structure integrally formed on the insulating strip body and configured to retain the covering profile.

16. The insulating strip according to claim 15, wherein the at least one attachment structure comprises a structure selected from a clip head projecting from at least one side in the height-direction and a clip retainer having a recess extending in the height-direction.

17. The insulating strip according to claim 16, wherein the covering profile is configured to be folded or bent over the insulating strip body so as to cover one side of the openings in the transverse direction and to detachably clip onto the at least one attachment structure so as to secure the covering profile in the opening-covering position.

18. The insulating strip according to claim 17, wherein the struts have a width in the longitudinal direction of between about 1 mm and 3 mm and the openings have a width in the longitudinal direction of between about 1 mm to 5 mm.

19. The insulating strip according to claim 18, wherein the struts are flexible and enable the first longitudinal edge to displace relative to the second longitudinal edge in the longitudinal direction when the first and second longitudinal edges are subjected to different temperature conditions.

20. The insulating strip according to claim 19, wherein the arrangement of the struts and the longitudinal edges gives the body of the insulating strip an overall ladder-shaped appearance in plan view.

* * * * *